US005415362A

United States Patent [19]

Lorenzo

[11] Patent Number: 5,415,362

[45] Date of Patent: May 16, 1995

[54] FLANGED BOBBIN

[76] Inventor: Angel Lorenzo, 28-38 Calle Sant-Pelegri, 08301 Mataro, Spain

[21] Appl. No.: 78,426

[22] Filed: Jun. 16, 1993

[30] Foreign Application Priority Data

Jun. 16, 1992 [ES] Spain ..... 9201904 U

[51] Int. Cl.[6] ..... B65H 75/22

[52] U.S. Cl. ..... 242/608.6; 242/610.6

[58] Field of Search ..... 242/71.8, 115, 116, 242/118.2, 118.4, 118.6, 118.61, 118.8, 608.6, 610.6

[56] References Cited

U.S. PATENT DOCUMENTS

| | | | |
|---|---|---|---|
| 864,268 | 8/1907 | Schatz | 242/71.8 |
| 1,839,223 | 1/1932 | Jones | 242/118.4 |
| 1,942,951 | 1/1934 | Baxenden et al. | 242/71.8 |
| 2,309,539 | 1/1943 | Roehrl | 242/118.8 X |
| 2,529,420 | 11/1950 | Ramquist | 242/71.8 X |
| 3,442,464 | 5/1969 | Broos | 242/71.8 |
| 3,552,677 | 1/1971 | Hacker | 242/118.61 |
| 3,822,841 | 7/1974 | Campbell | 242/115 |
| 3,846,887 | 11/1974 | Woods et al. | 242/115 |
| 3,940,085 | 2/1976 | Campbell | 242/115 |
| 5,143,316 | 9/1992 | Goetz et al. | 242/116 |

FOREIGN PATENT DOCUMENTS

| | | |
|---|---|---|
| 564646 | 10/1958 | Germany . |
| 1761616 | 7/1971 | Germany . |
| 150266 | 9/1969 | Spain . |

OTHER PUBLICATIONS

Spanish Industrial model 89.606, D. Angel Lorenzo Barroso, May 13, 1977.

*Primary Examiner*—John M. Jillions
*Attorney, Agent, or Firm*—Michael J. Striker

[57] ABSTRACT

A flanged bobbin, has a central substantially cylindrical body member having an axis and two edges at each axial end. The body member is divided into at least two parts each having a first engaging formation provided substantially near the edge of the respective one of the parts, and two substantially flat discs forming lateral flanges of the bobbin and each arranged at the respective one of the ends of the body member. Each of the discs has a central aperture which is limited by an inner edge. The inner edge of each of the discs has a second engaging formation which engages a first engaging formation of the parts snugly and removably by overcoming resilience of a material of one of the body member and the disc.

11 Claims, 3 Drawing Sheets

FIG. 1
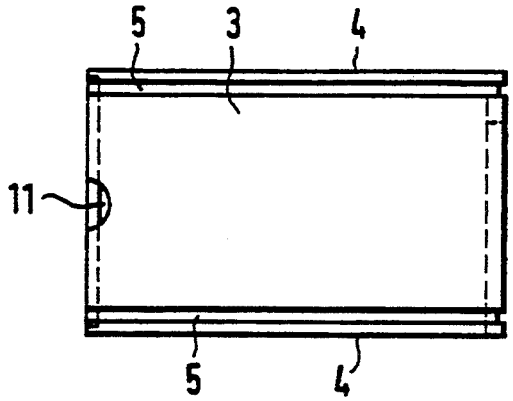
FIG. 3
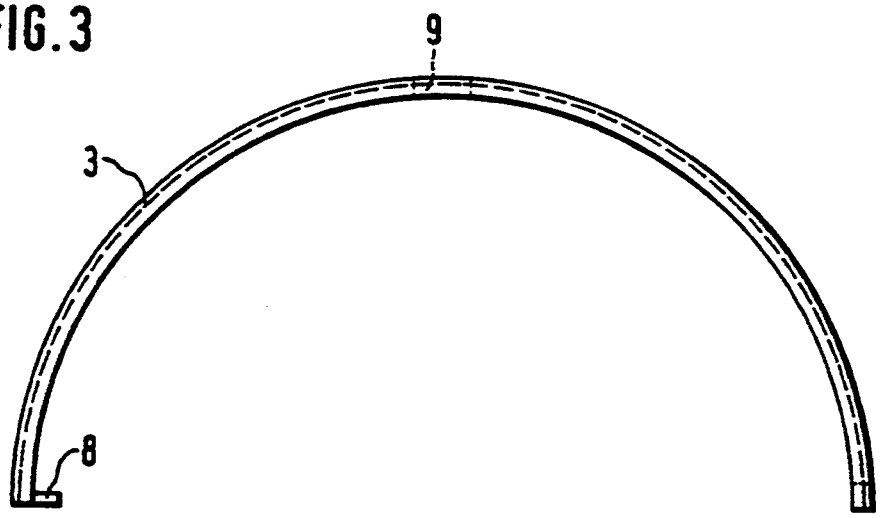
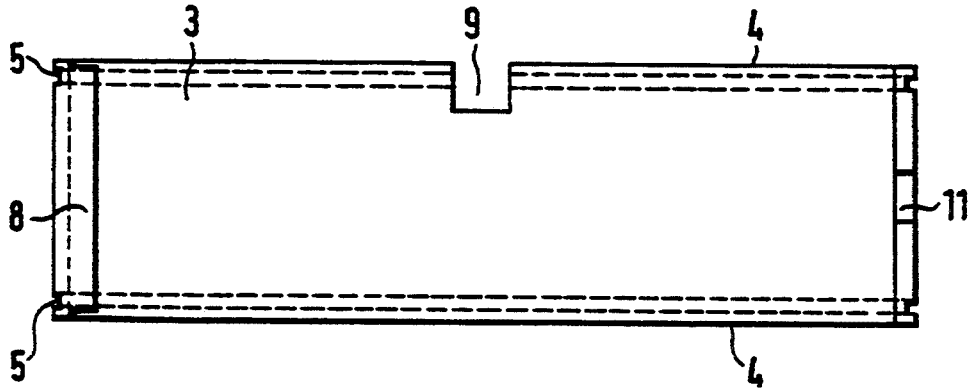
FIG. 2

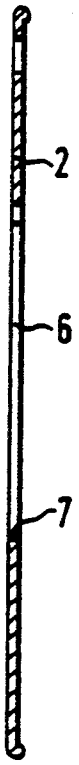
FIG. 5
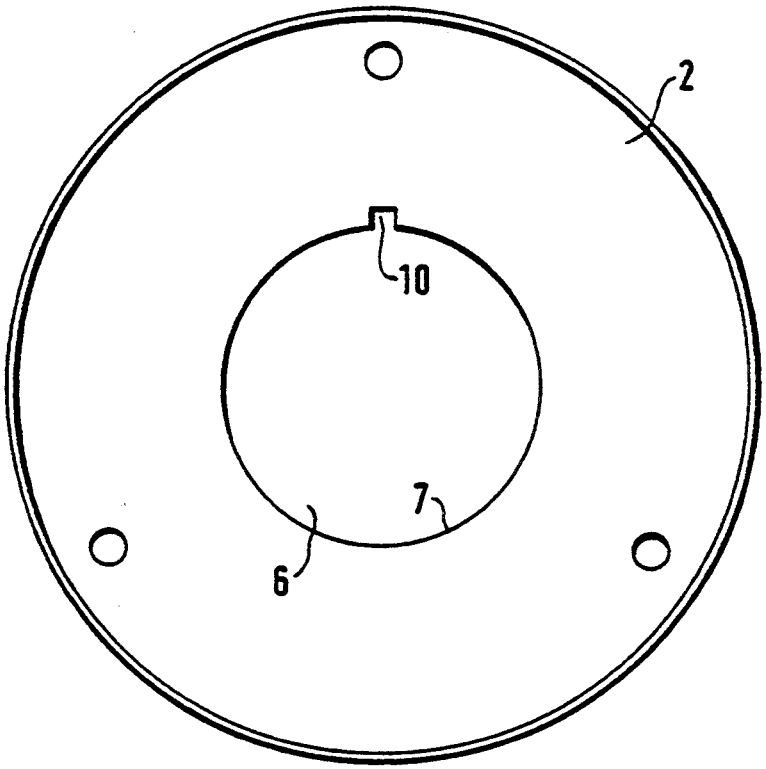
FIG. 4
FIG. 6
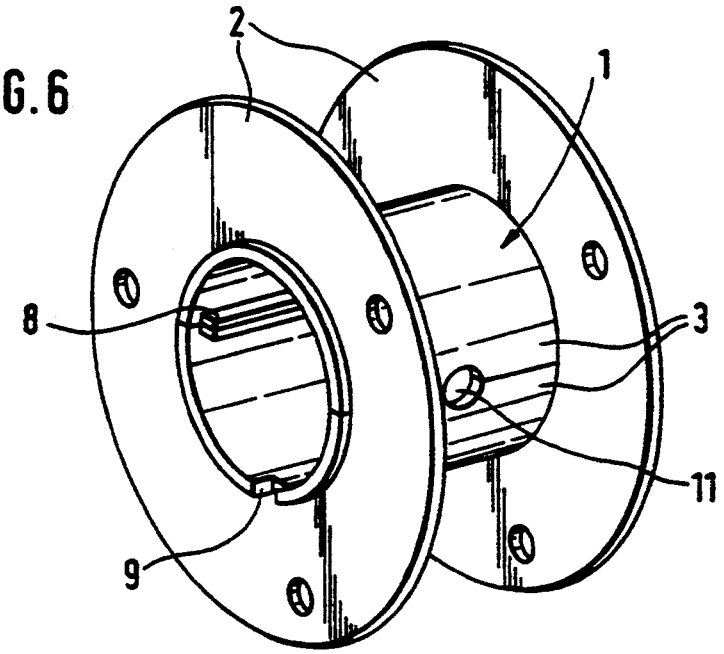

FLANGED BOBBIN

BACKGROUND OF THE INVENTION

The present invention relates to flanged bobbins.

More practically, it relates to flanges bobbins which have a central hollow cylindrical body member, and substantially flat discs have a larger diameter, arranged at the end of the cylindrical member and forming large lateral flanges of the bobbin.

Flanged bobbins of this type are used particularly for transportation, storage and handling of long filiform members or the like, such as for example types, tapes, strips of staples, etc., which are wound on the bobbins.

Flanged bobbins of the above mentioned type are well known. One of such flanged bobbins used in handling of long strips of stapes for sausages is disclosed in utility motel ES 150,266, in German patents DE 564,646 and 1,761,616 and in Spanish industrial model 89,906. The flanged bobbins disclosed in these documents are formed as a single piece element composed of plastic material, cardboard or similar material and may be disposable or reusable. The flanged bobbin of the first type, or in other words the flanged bobbin which is not retrievable and is disposable, involves a high destruction or regeneration cost. When the flanged bobbin to the contrary is returnable and reusable, it also has a high carriage cost, since its great volume relative to its low weight means that only a small fraction of the total number of flanged bobbins that could be carried from the point of view of weight may be carried by any particular means of transportation.

SUMMARY OF THE INVENTION

Accordingly, it an object of the present of the invention to provide a flanged bobbin which avoids the disadvantages of the prior art.

In keeping with these objects and with others which will become apparent hereinafter, one feature of the present invention recides, briefly stated, in a flanged bobbin which has a hollow cylindrical body member divided into at least two equal parts along a radial plane and provided on their outer surfaces substantially close to the edges of their ends with a groove extending substantially parallel to the edge, and discs which form large lateral flanges and provided with a central aperture having an edge snugly and removably inserted in the grooves of the parts of the cylindrical body member while the parts of the cylindrical body member are removably inserted with their edges into large apertures of the discs due to resilience of the material of the parts of the cylindrical body member.

When the flanged bobbin is designed in accordance to the present invention, it eliminates the disadvantages of the prior art.

The novel features of the present invention are set forth in particular in the appended claims. The invention itself, however, both as to its construction and its manner of operation will be best understood from the following description of preferred embodiments, which is accompanied by the following drawings.

BRIEF DESCRIPTION OF THE DRAWINGS

FIGS. 1, 2, and 3 are respectively a front elevational view, a plan view and a side view of a semi-cylindrical half of a flanged bobbin body of the flanged bobbin in accordance with the present invention;

FIGS. 4 and 5 are respectively a front elevational view and a side view of a side disc of the flanged bobbin in accordance with the present invention;

FIG. 6 is a perspective view of the flange bobbin in accordance with the present invention, in its final form;

DESCRIPTION OF PREFERRED EMBODIMENTS

Figure 7:
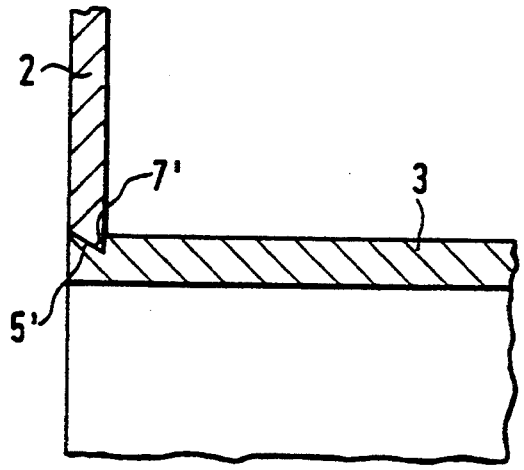
FIGS. 7, 8 and 9 are sectional views of respective embodiments of a coupling between the parts of the cylindrical body member and the lateral disks on an enlarged scale.

As shown in the drawings a flanged bobbin in accordance with the present invention has a central cylindrical hollow body member 1, and two substantially flat discs 2 which are arranged at the opposite axial ends of the body member 1 and extend perpendicular to the axis of the body member.

The body member 1 is subdivided preferably along a diametrical plane into several parts. In particular, as shown in the preferred embodiment, it is subdivided into two equal halves 3. Each half 3 of the body member 1 is provided on its outer surface with two grooves 5. Each of the grooves is located close to a respective edge 4 of the half 3 and extends parallel to the edge.

The discs 2 define large lateral flanges of the flanged bobbin 1. Each of the discs 2 have a central aperture 6 which is limited by an edge 7. The edge 7 of each disc 2 is formed to be inserted snugly and removably into the grooves 5 provided at one end of the two semi-cylindrical halves 3.

FIG. 6 shows the flanged bobbin in accordance with the present invention in an assembled condition. As can be seen from this figure, the edges 7 of the aperture 6 of discs 2 are inserted in the grooves 5 of the semi-cylindrical halves 3. The grooves 5 are preferably U-shaped and have sharp edges and corners.

Figure 8:
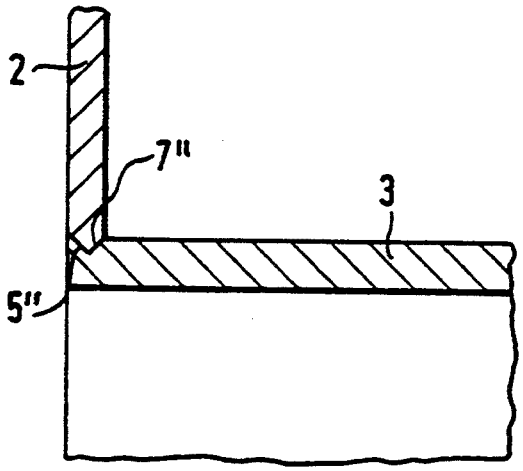

In accordance with the embodiment shown in FIG. 7, the grooves 5' of the halves 3 have a substantially triangular shape with an acute angle, and the edge 7' of the discs 2 is formed correspondingly. In accordance with the embodiment shown in FIG. 8, the grooves 5'' have a V-shape with a sharp angle, and the edge 7 of the discs 2 is shaped correspondingly. The edges 7' and 7'' of the discs 2 are insertable into the grooves 5' and 5'' of the body member 1.

Figure 9:
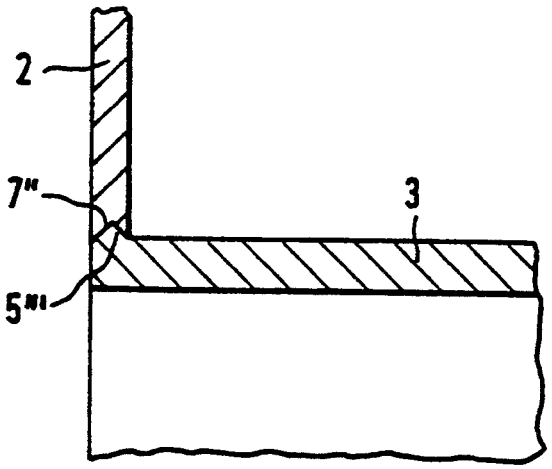

In accordance with the further embodiment of the present invention shown in FIG. 9, each half 3, instead of the groove, is provided with a rib 5'''. The edge 7''' of each disc 2 is provided with a groove of a corresponding shape, so that the rib 5''' of the body member 3 is insertable into the groove 7''' of the discs 2.

At least the body member 3 is composed of a resilient material. Therefore, in order to assemble the flanged bobbin, the discs 2 can be pressed in an axial direction on to the body member 1 so as to overcome the resistance of the resilient material and to finally engage the respective formations of the body member 3 and the discs 2 with one another. Disassembling of the flanged bobbins can be performed in a reverse order by pulling the discs 2 in opposite axial directions from the body member 3 and overcoming the resistance of the resilient material. It is of course to be understood, that instead of forming the body member 3 over the resilient material or in addition to it, the discs 2 can be made of resilient material as well, for the same purpose.

As can be seen from the drawings each half 3 of the body member 1 has a rib 8 which is arranged internally on one of its edges. The rib 8 of one half 3 together with the rib 8 of the other half 3 form keys for facilitating driving of the flanged bobbin. Furthermore, the body member 1 is provided with notches 9 and 11 while the discs 2 are provided with notches 10 to facilitate the handling, and also assembling and disassembling of the flanged bobbin.

It will be understood that each of the elements described above, or two or more together, may also find a useful application in other types of constructions differing from the types described above.

While the invention has been illustrated and described as embodied in a flanged bobbin, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A flanged bobbin, comprising a central substantially cylindrical body member composed of a resilient material and having an axis and two edges at each axial ends, said body member being divided into at least two parts each composed of a resilient material and having a first engaging formation provided substantially near said edge of the respective one of said parts: and two substantially flat discs composed of a resilient material, said flat discs forming lateral flanges of the bobbin and each arranged at the respective one of the ends of said body member, each of said discs having a central aperture which is limited by an inner edge, said inner edge of each of said discs having a second engaging formation which engages said first engaging formation of said parts snugly and removably by overcoming resilience of a material of said parts of said body member and said discs.

2. A flanged bobbin as defined in claim 1, wherein said cylindrical body member is divided along its central diametrical plane so that said two parts are identical.

3. A flanged bobbin as defined in claim 1, wherein one of said first engaging formation and said second engaging formation is formed as a groove, while another of said first engaging formation and said second engaging formation is formed as a projection snugly and removably engageable in said groove.

4. A flanged bobbin as defined in claim 3, wherein said grooves are formed on an outer surface of said body member, said projections being formed on said inner edge of each of said discs.

5. A flanged bobbin as defined in claim 3, wherein said groove is formed in said inner edge of each of said discs, said projections being formed on an outer surface of said body member.

6. A flanged bobbin as defined in claim 3, wherein said projections and said grooves have a rectangular cross-section with sharp edges and corners.

7. A flanged bobbin as defined in claim 3, wherein said projection and said groove have a triangular cross-section.

8. A flanged bobbin as defined in claim 3, wherein said projection and said groove have a V-shaped cross-section.

9. A flanged bobbin as defined in claim 1, wherein each of said parts has a rib provided in the region of one of said edges are formed so that said ribs of said parts contact one another in assembled condition of the bobbins.

10. A flanged bobbin as defined in claim 1, wherein said body member has at least one notch for facilitating handling, assembling and disassembling of the flanged bobbin.

11. A flanged bobbin as defined in claim 1, wherein each of said discs is provided with a notch for facilitating handling, assembling and disassembling of the flanged bobbin.

* * * * *